United States Patent [19]

Balder et al.

[11] 3,995,182

[45] Nov. 30, 1976

[54] LOW-PRESSURE SODIUM VAPOR DISCHARGE LAMP

[75] Inventors: Jan Jacob Balder, Eindhoven, Netherlands; Henricus Johannes Joseph Van Boort, deceased, late of Eindhoven, Netherlands, by Tomas Lammert Willem Reininga, administrator

[73] Assignee: U.S. Philips Corporation, New York, N.Y.

[22] Filed: Nov. 12, 1975

[21] Appl. No.: 631,368

[30] Foreign Application Priority Data

Nov. 14, 1974 Netherlands ..... 7414849

[52] U.S. Cl. ..... 313/113; 313/112

[51] Int. Cl.[2] ..... H01J 7/24; H01J 61/35

[58] Field of Search ..... 313/112, 113, 114, 115

[56] References Cited

UNITED STATES PATENTS

| | | | |
|---|---|---|---|
| 3,162,785 | 12/1964 | Scoledge et al. | 313/112 |
| 3,174,067 | 3/1965 | Bahrs | 313/113 |
| 3,188,513 | 6/1965 | Hansler | 313/112 |
| 3,225,241 | 12/1965 | Spencer et al. | 313/113 |
| 3,400,288 | 9/1968 | Groth | 313/112 |
| 3,767,956 | 10/1973 | Bauer | 313/113 |

FOREIGN PATENTS OR APPLICATIONS

| | | | |
|---|---|---|---|
| 227,158 | 3/1960 | Australia | 331/113 |

*Primary Examiner*—R. V. Rolinec
*Assistant Examiner*—John Kominski
*Attorney, Agent, or Firm*—Frank R. Trifari

[57] ABSTRACT

The invention relates to a low pressure sodium vapor discharge lamp for generating a directed light beam in which the lamp is provided with a cylindrical discharge tube which is enveloped by a cylindrical outer bulb.

According to the invention the inside of the outer bulb is provided, in a cross-section of the lamp over at least 270° of arc, with a reflecting layer which has a large reflection factor for sodium light and a very small reflection factor for infra-red radiation.

The lamp according to the invention may for example be used in an exposure apparatus for photocopying texts and figures.

5 Claims, 2 Drawing Figures

LOW-PRESSURE SODIUM VAPOR DISCHARGE LAMP

The invention relates to a low pressure sodium vapour discharge lamp for generating a directed light beam, which lamp is provided with a cylindrical discharge tube and with a cylindrical outer bulb which envelopes this tube, the discharge tube being mounted in a reflector, which reflector is located within the outer bulb and which has a reflection factor for sodium light which exceeds 50%. The invention also relates to an exposure apparatus provided with such a lamp.

The term sodium light is used herein to mean an electromagnetic radiation having a wavelength of approximately 5900A, i.e. of approximately 0.59 micron.

A known low pressure sodium vapour discharge lamp of the said type is, for example, described in British patent specification No. 389,726. A drawback of that known lamp is that the light beam which is generated with it, is a rather wide beam. Therefore, the average luminous intensity of the lamp within the beam is relatively small.

The object of the invention is to provide a low pressure sodium vapour discharge lamp of the aforementioned type which can generate a narrow light beam of great intensity.

A low pressure sodium vapour discharge lamp according to the invention for generating a directed light beam, which lamp is provided with a cylindrical discharge tube and with a cylindrical outer bulb which envelopes this tube, the discharge tube being mounted in a reflector which reflector is located within the outer bulb and which has a reflection factor for sodium light which exceeds 50%, is characterized in that the reflector is provided with such a longitudinal slit that in practically every cross-section of the lamp which is located in a plane perpendicular to the longitudinal axis of the discharge tube the angle between the lines from the centre of the discharge tube to the two limits of the slit is smaller than 90° degrees of arc and that the reflection factor of the reflector for infra-red radiation, having a wave-length exceeding 5 microns, is smaller than 20%.

The upper limit of the wave-length of the infra-red radiation is at approximately 10 microns.

An advantage of a lamp according to the invention is that it is suitable for generating a relatively narrow light beam of a high intensity. By way of explanation the following can be stated: The invention is based on the recognition that for a narrow light beam, i.e. for a small light output slit in the reflector of the lamp, a reflection by that reflector of an infra-red radiation — also generated in the discharge tube — should be low. Such a low reflection for infra-red radiation of a reflector in a sodium lamp is an exceptionally surprising condition at the presentday, usual requirements for such a lamp. For, in known cases it is usually tried to recast that infra-red radiation into the discharge tube to maintain the temperature of the tube. However, the inventors have recognized that a reduction of the light output slit in the reflector of the lamp, when a reflector is used which reflects the infra-red radiation very well, would lead to an excessive operating temperature of the discharge tube. This could indeed be avoided by reducing the wattage of the discharge tube at the same time. But both too high an operating temperature — and a low wattage — of the discharge tube are both not suitable to result in a lamp whose object it is to generate a beam of a high light intensity.

In a lamp according to the invention part of the efficiency of the light generation is sacrificed (by a lower heat insulation), to be able to obtain yet a high lamp load and consequently a high beam intensity.

The reflector may, for example, be located halfway between the discharge tube and the outer bulb. The reflector may, for example, be furthermore clamped between indentations of the outer bulb wall.

In a preferred embodiment of a low pressure sodium discharge lamp according to the invention the reflector is located at the inside of the outer bulb.

An advantage of this preferred embodiment is that the fastening of the reflector to the outer bulb may be very simple.

The longitudinal axis of the slit of the reflector may, for example, be curved round the longitudinal axis of the discharge tube in the form of a helix. In that case thoughts go towards a relatively large pitch of the helix. A lamp provided with a reflector having such a helix-shaped slit could, for example, be used to obtain a special light effect. To that end this lamp could then, for example, revolve around the longitudinal axis of its outer bulb.

In a further preferred embodiment of a lamp according to the invention in which the longitudinal axis of the slit of the reflector is substantially parallel to the longitudinal axis of the outer bulb, the longitudinal axis of the outer bulb is located between the longitudinal axis of the slit of the reflector and the longitudinal axis of the discharge tube.

An advantage of this preferred embodiment is that this may lead to an even stronger concentration — so a narrower beam — of the sodium light.

The reflector comprises, for example, a reflective layer of magnesium oxide or of titanium dioxide ($TiO_2$) or of another material which transmits the said infrared radiation well.

It should be observed that reflective layers of titanium dioxide are in itself known in some types of low pressure mercury vapour discharge lamps. Also these layers are used to obtain a concentration of the light of the lamp. In those low pressure mercury vapour discharge lamps, however there is no outer bulb as in a lamp according to the invention. Furthermore, the problems outlined with respect to the infrared radiation do not occur due to the fact that the operating temperature of those known low pressure mercury vapour discharge lamps is considerably lower than that of the low pressure sodium lamps subject of the invention.

Lamps according to the invention may for example be used for public lighting purposes, for example to illuminate a road bridge from railing level.

Preferably a reflector lamp according to the invention is used in an exposure apparatus and that for the fact that then very efficient use of the concentrated light radiation is possible. It may be added that, for exposures, a high intensity of the beam often is of fundamental importance. In this respect an exposure to enable the photographic recording of rapidly occurring events may, for example be mentioned.

In another case the exposure apparatus is used, for example, for photocopying by means of the sodium lamp according to the invention. Photocopying of texts and/or figures is then concerned.

This photocopying can then also be done in a similar way as occurs in a known exposure apparatus which is provided with a low pressure mercury vapour discharge lamp. When a sodium lamp according to the invention is used in a photocopying apparatus the light-sensitive material used must of course have a spectral sensitivity which is adapted to the sodium radiation.

The invention will be further explained with reference to a drawing in which.

Figure 1:
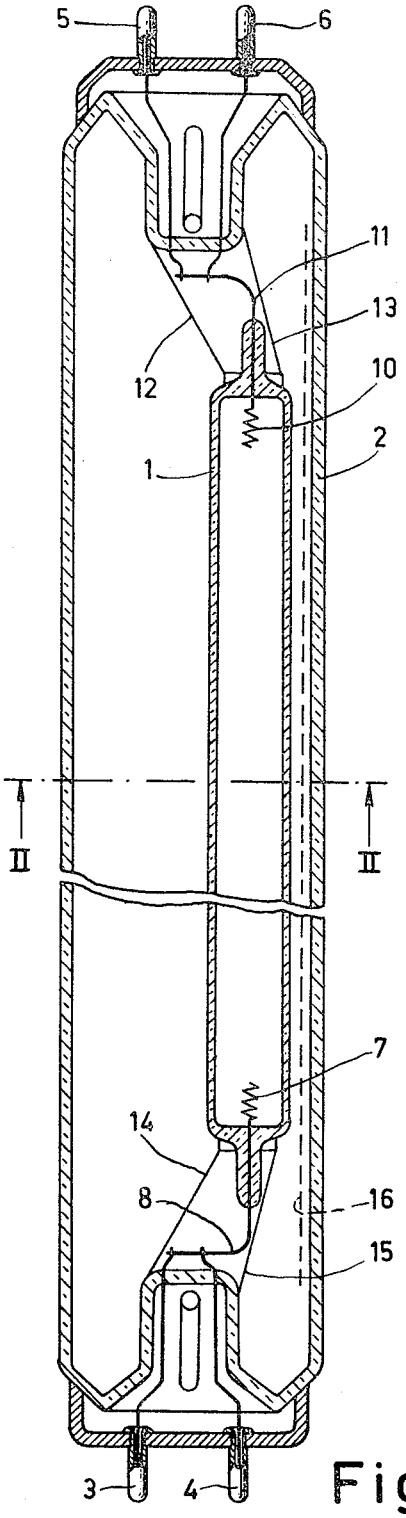
FIG. 1 is a longitudinal section through a lamp according to the invention.

Reference 1 in FIG. 1 is a cylindrical discharge tube of a low-pressure sodium vapour discharge lamp which consumes approximately 115 Watts in the operating condition. The tube 1 is asymmetrically arranged in an outer bulb 2. The longitudinal axis of the tube 1 and that of the outer bulb 2 are parallel to one another. References 3 and 4, and 5 and 6 respectively indicate current supply elements of the lamp. The lamp shown is a so-called linear lamp, i.e. an elongated lamp. The electrode 7 of the tube 1 is connected to the supply elements 3 and 4 of the lamp via a current supply conductor 8. The electrode 10 of the tube 1 is connected in a similar way to the supply elements 5 and 6 via a current supply conductor 11. A large part of the inner surface of the wall of the outer bulb 2 is coated with a reflective layer 16 consisting of titanium dioxide ($TiO_2$). In the Figure this layer is indicated by means of a dashed line. References 12 to 15 indicate supporting elements which are used to bear the tube 1 with respect to the outer bulb 2.

The lamp shown in FIG. 1 has a length of approximately 530 mm. The diameter of the outer bulb 2 is approximately 38 mm. The length of the discharge tube 1 is approximately 400 mm. The distance from the longitudinal axis of the discharge tube 1 to the longitudinal axis of the outer bulb 2 is approximately 7 mm. The operating temperature of the wall of the discharge tube 1 is approximately 260° C. The reflection factor of the titanium dioxide layer 16 exceeds 80% for sodium light and is less than 10% for the infra-red radiation having a wavelength exceeding 5 microns.

Reference 1 in FIG. 2 again represents the discharge tube and reference 2 the outer bulb. From the centre of the discharge tube lines have been drawn to the two limits of the slit of the reflector 16. This reflector is formed by the titanium dioxide at the inside of the bulb 2. The two lines are at an angle of approximately 45° of arc with respect to one another, i.e. an angle which is smaller than the maximum angle of 90° of arc. Reference L in FIG. 2 indicates the light distribution of the lamp in a part of the cross-sectional area II—II shown. It appears herefrom that the beam is rather narrow. The light intensity of the lamp in that bundle is large. For example, in the centre of the beam the light intensity of the lamp is approximately 45 candela per cm length of the discharge tube.

Figure 2:
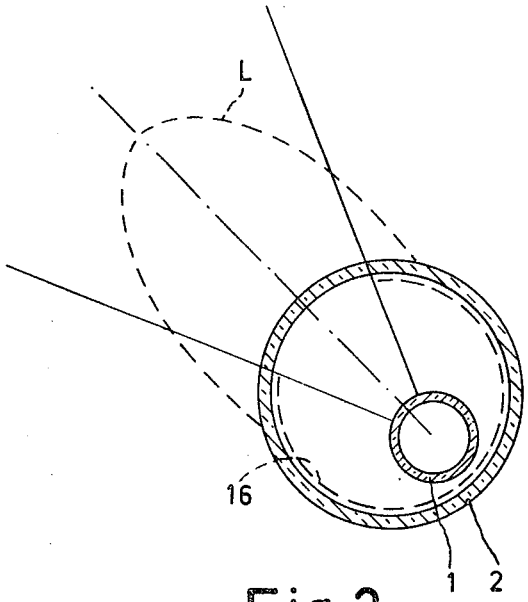
FIG. 2 is a cross-section II—II through an outer bulb and through a discharge tube of the lamp which is depicted in FIG. 1.

If the elongated low pressure sodium vapour discharge lamp would not have been provided with the titanium dioxide reflector but with a metal reflector having the same slit width as in the lamp of FIG. 2 and which would reflect both sodium light and infra-red radiation, the maximum wattage could be not more than half of 115 watts, namely approximately 60 watts, for reasons of heat. This would result in the centre of the light beam in a luminous intensity of only approximately 30 candela per cm length of the discharge tube. That is only approximately 65% of the corresponding luminous intensity for the lamp described according to the invention.

The larger intensity in the beam of the lamp according to the invention results, when that lamp is used in exposure apparatus for photocopying purposes, in that the exposure time of a document can be short and that consequently the speed of reproduction can be high.

What is claimed is:

1. A low pressure sodium vapour discharge lamp for generating a directed light beam, which lamp is provided with a cylindrical discharge tube and with a cylindrical outer bulb which envelopes this tube, the discharge tube being mounted in a reflector, which reflector is located within the outer bulb and which has a reflection factor for sodium light which exceeds 50%, characterized in that the reflector has been provided with such a longitudinal slit that in substantially every lamp section which is located in a plane perpendicular to the longitudinal axis of the discharge tube the angle between the lines from the centre of the discharge tube to the two limits of the slit is smaller than 90° and the reflection factor of the reflector is smaller than 20% for infra-red radiation having a wave-length exceeding 5 microns.

2. A low pressure sodium vapour discharge lamp as claimed in claim 1, characterized in that the reflector is located at the inside of the outer bulb.

3. A low pressure sodium vapour discharge lamp as claimed in claim 2, in which the longitudinal axis of the slit of the reflector is substantially parallel to the longitudinal axis of the outer bulb, characterized in that the longitudinal axis of the outer bulb is situated between the longitudinal axis of the slit of the reflector and the longitudinal axis of the discharge tube.

4. A low pressure sodium vapour discharge lamp as claimed in claim 1, characterized in that the reflector has a reflective layer which consists of titanium dioxide ($TiO_2$).

5. An exposure apparatus provided with a low pressure sodium vapour discharge lamp as claimed in claim 1.

* * * * *

UNITED STATES PATENT AND TRADEMARK OFFICE

CERTIFICATE OF CORRECTION

PATENT NO. : 3995182

DATED : November 13, 1976

INVENTOR(S) : Jan Jacob Balder et al

It is certified that error appears in the above-identified patent and that said Letters Patent are hereby corrected as shown below:

Column 1, line 46, "10" should be --100--.

Signed and Sealed this

Third Day of May 1977

[SEAL]

*Attest:*

RUTH C. MASON
*Attesting Officer*

C. MARSHALL DANN
*Commissioner of Patents and Trademarks*